US008709534B2

(12) United States Patent
Eisenreich et al.

(10) Patent No.: US 8,709,534 B2
(45) Date of Patent: Apr. 29, 2014

(54) FORMWORK RELEASE COMPOSITION AND USE THEREOF

(75) Inventors: Andreas Eisenreich, Beilstein (DE); Sergi Vilches, Santa Perpetua de Mogoda (ES); Andres Fernandez, Caldes de Montbui (ES); Josep Gatell, Barcelona (ES); Uwe Holland, Berikon (CH)

(73) Assignee: Construction Research & Technology GmbH, Trostberg (DE)

( * ) Notice: Subject to any disclaimer, the term of this patent is extended or adjusted under 35 U.S.C. 154(b) by 513 days.

(21) Appl. No.: 12/993,529

(22) PCT Filed: May 14, 2009

(86) PCT No.: PCT/EP2009/055797

§ 371 (c)(1),
(2), (4) Date: Aug. 15, 2011

(87) PCT Pub. No.: WO2009/144140

PCT Pub. Date: Dec. 3, 2009

(65) Prior Publication Data

US 2012/0125230 A1 May 24, 2012

(30) Foreign Application Priority Data

May 30, 2008 (EP) ..... 08104188

(51) Int. Cl.
*B28B 7/38* (2006.01)

(52) U.S. Cl.
USPC .... 427/133; 106/38.2; 106/38.22; 106/38.24; 106/724; 106/802; 106/807

(58) Field of Classification Search
USPC ..... 106/38.2, 38.22, 38.24, 266, 724, 802, 106/807; 427/133
See application file for complete search history.

(56) References Cited

U.S. PATENT DOCUMENTS

| | | | |
|---|---|---|---|
| 5,595,813 | A | 1/1997 | Ogawa et al. |
| 6,409,821 | B1 | 6/2002 | Cassar et al. |
| 6,935,606 | B2 | 8/2005 | Chan |
| 2003/0041541 | A1 | 3/2003 | Chan |
| 2004/0176259 | A1 | 9/2004 | Esselbrugge et al. |
| 2006/0078712 | A1 | 4/2006 | Thierauf et al. |
| 2006/0099397 | A1 | 5/2006 | Thierauf et al. |
| 2009/0188407 | A1 | 7/2009 | Karvinen |
| 2010/0107928 | A1 | 5/2010 | Venon et al. |

FOREIGN PATENT DOCUMENTS

| | | | | |
|---|---|---|---|---|
| DE | 44 18 807 | A1 | | 12/1995 |
| DE | 19852203 | A1 | * | 5/2000 |
| EP | 0 590 477 | A1 | | 4/1994 |
| EP | 1900702 | A1 | * | 3/2008 |
| JP | 5-69428 | A | * | 3/1993 |
| JP | 2003-211423 | | * | 7/2003 |
| JP | 2004-210988 | | | 7/2004 |
| JP | 2006-001886 | A | * | 1/2006 |
| WO | WO 98/05601 | | | 2/1998 |
| WO | WO 03/101912 | A1 | | 12/2003 |
| WO | WO 2005/066286 | A1 | | 7/2005 |
| WO | WO2007/102960 | A2 | * | 9/2007 |
| WO | WO2008/052818 | A1 | * | 5/2008 |
| WO | WO 2008/087298 | A1 | | 7/2008 |

OTHER PUBLICATIONS

PCT/EP2009/055797—Written Opinion of the International Searching Authority, Jul. 29, 2009.
PCT/EP2009/055797—International Search Report, Jul. 29, 2009.

* cited by examiner

*Primary Examiner* — Anthony J Green

(74) *Attorney, Agent, or Firm* — Curatolo Sidoti Co., LPA; Joseph G. Curatolo; Salvatore A. Sidoti

(57) ABSTRACT

A formwork release composition containing formwork release oil, which contains a hydrophobic metal oxide and/or metal sulphide component is disclosed. Photocatalytically active compounds, such as particular semiconductors and in particular $TiO_2$, are particularly suitable. The invention also concerns the use of the formwork release composition for producing exposed concrete. The concrete and mortar products thus produced are characterized by a homogeneous surface with self-cleaning properties that gives an enhanced resistance against weathering and a much longer lasting brilliance and whiteness.

11 Claims, No Drawings

FORMWORK RELEASE COMPOSITION AND USE THEREOF

CROSS REFERENCE TO RELATED APPLICATIONS

This application is a national stage application of International Application No. PCT/EP2009/055797, filed 14 May 2009, which claims priority from European Patent Application Serial No. 08 104 188.1, filed 30 May 2008, from which applications priority is claimed, and which are incorporated herein by reference.

In the production of prefabricated concrete parts, but also in the use of site-mixed concrete, ready-mixed concrete and the like, the unset concrete is poured into a formwork (mould) which mostly consists of wood, ceramic, metal or plastic. After setting and demoulding the concrete in question is referred to as exposed concrete. For the avoidance of damage which can occur due to mechanical forces during demoulding, concrete release agents (formwork release agents) are usually applied onto the contact side of the formworks. The purpose of these release agents is to decrease or prevent adhesion between concrete and formworks. However, the disadvantage of these very smooth exposed concrete surfaces is that with the passage of time the appearance of these surfaces is impaired by soiling.

The concrete release compositions known in the art mainly contain an oil component, such as for example mineral oils, waxes or triglycerides. To improve the product properties, additives in the form of preservatives, wetting agents, antioxidants and also, in aqueous systems, emulsifiers are usually added to these.

In the German laid-open specification DE 44 18 807, an aqueous formwork release agent is described, to which a rust inhibitor is also added for the avoidance of corrosion phenomena on metal formworks. However, the soiling which occurs on the concrete surface through weathering cannot be prevented with this composition.

From EP 0 590 477 A1, a construction material onto the surface whereof a thin metal oxide film with a photocatalytic action is applied is known. For the hardening of the metal oxide film, an additional step, such as for example annealing at higher temperatures or anodic oxidation, is necessary. However, under construction site conditions this additionally required step cannot be performed.

A moulded body made of oxide ceramic base material is described by WO 03/101912 A1. On spraying or irrigation with water, this moulded body has self-cleaning properties. The surface responsible for this effect is a combination of suspended and photocatalytically active metal oxides with a nanostructured surface. The suspension used in the connection also has to be annealed at higher temperatures.

A dry mortar which contains photocatalytically active particles is described in WO 98/05601 A1. This dry mortar can be used both directly as concrete, but can also be applied subsequently onto existing concrete surfaces as a repair mortar. A disadvantage is the fact that the photocatalytically active particles are distributed over the whole mortar cross-section and thus the quantities used for adequate coating of the visible surface are very large and thus very cost intensive.

An overview concerning photocatalytic processes in cement-bonded construction materials is given by the corresponding article in Cement International March 2005, vol. 3, pages 93 to 97. As a typical example of a photocatalytic additive, titanium dioxide, which as the most well-known white pigment is very widely encountered, is in particular mentioned here. In this publication, it is also stated that in cement-bonded construction materials, titanium dioxide can degrade inorganic and organic atmospheric pollutants. The advantageous aesthetic specifications which can be fulfilled over a prolonged period through the use of a photocatalyst, since organic compounds which can lead to discoloration are also degraded thereby, are in particular described. The effect of titanium dioxide compared to concrete test pieces which contain no titanium oxide was ascertained using colorimetric methods.

Titanium dioxide occurs in the three mineralogical modifications rutile, anatase and brookite, among which only the anatase modification displays photoactive properties. Rutile is rated as photoinactive or only very slightly active. This is connected with a low specific surface area and is also due to low adsorption of water or hydroxyl groups. The photoactive anatase can be activated by UV irradiation at a wavelength of 388 nm; rutile undergoes its slight activation at a wavelength of 413 nm. This difference in the conduction band makes more energy available to the anatase for the formation of superoxide ions. The capacity of rutile and anatase for the formation of hydroxyl radicals is however rated as identical. In applications in the outdoor area, in which natural solar radiation is utilized, the anatase modification has an advantageous photo-oxidative activity.

A process for the treatment of surfaces with titanium dioxide is known from the published PCT application WO 2005/066286 A1. The treatment composition is used as a powder or aqueous solution, and contains nanocrystalline titanium dioxide. After this composition has been distributed on the surface in question using water, it remains there even after exposure to physical influences, and forms a photocatalytic and/or antisoiling layer. The particle size of the nanocrystalline titanium dioxide should be between 3 and 200 nm. This composition can additionally contain hydrophilic inorganic oxides such as zinc oxide, tin oxide or iron oxide. As preferred surfaces for treatment, ceramics and glass, such as for example bathroom and kitchen tiles, enamelled surfaces and also metal surfaces may be mentioned.

For the present invention, the objective was to provide concrete and mortar construction components which have surfaces with self-cleaning properties and can be produced in economic terms. Especially there should be no additional production steps or curing steps, which are time-consuming and are not economical. In this context, great importance is attributed to the formwork release composition used.

This problem was solved by a formwork release composition containing formwork release oil, which is characterized in that hydrophobic metal oxide component(s) and/or metal sulphide component(s) are contained. Preferred are hydrophobic metal oxide components.

Hydrophobicity of said inorganic component(s) can preferably be achieved by a chemical surface modification, for example with organic polysiloxanes. This hydrophobicity allows the proper interactions with the oil component (formwork release oil) to favour the homogeneous dispersion of inorganic metal oxide component(s) and/or metal sulphide component(s) within the oil, and furthermore preventing settlement and assuring long shelf life of the formwork release composition.

Entirely surprisingly it has been found that this formwork release composition has not only has a beneficial effect on the production of concrete and mortar surfaces with self-cleaning properties according to the objective, but that in addition it is also possible in particular to produce (white) concretes whose brilliance and whiteness surpasses that of conventional white concrete also after years of weathering. In addition, the affects achievable can be observed not only on smooth surfaces, but also on rough and/or porous structures. Also advantageously, it could be established that such uniform white surfaces of concrete can be produced without the otherwise usual additional metal oxide or titanium dioxide coatings. In particular, preferably no additional additives besides the formwork release composition according to the invention are needed.

The effects of the present invention are as self-cleaning properties, low soiling tendency and also the suppression of undesired biological fouling (e.g. algae, yeasts, lichens, fungi, etc.) The concrete surfaces are stable to weathering and said effects are still observable without impairment even after at least two years.

In a particular embodiment of the invention, the formwork release composition is characterized in that the metal oxide component(s) and/or metal sulphide component(s) are surface-modified by coating with hydrophobic materials. This has the advantage that the metal oxide components and/or metal sulphide components can be better emulsified in the likewise hydrophobic formwork release oil. Thus improved working properties can be ensured, since a separation of the photoactive particles (e.g. settlement) from the oil phase can largely be avoided. In such a way a constant quality of the products and reliable results can be achieved.

In a further embodiment of the invention, the formwork release composition is characterized in that the hydrophobic coating materials are selected from the group of cyclic polysiloxanes, polysiloxanes and/or silicon-containing compounds, which have at least one C1-C18 alkyl, aryl and/or C1-C18 aralkyl group in their structure, whereby the silicon atom is substituted with at least one alkoxy group and/or at least one halogen atom, preferably Cl or Br. Preferably the silicon-containing compounds, which have at least one C1-C18 alkyl, aryl and/or C1-C18 aralkyl group in their structure are mono silicon compounds. For the purpose of coating, cyclic poly-siloxanes, such as hexamethylcyclotrisiloxane, octamethylcyclotetrasiloxane and/or decamethylcyclopentasiloxane are suitable. Polysiloxanes, for example polydimethylsiloxanes, are also suitable.

Silicon-containing compounds, preferably mono silicon compounds which have at least one C5-C12 alkyl group in their structure and more than one alkoxy group, preferably more than one methoxy group, are particularly preferred. As examples of particularly preferred coating materials, octyltrimethoxysilane, nonyltrimethoxysilane, decyltrimethoxysilane, undecyltrimethoxysilane and/or dodecyltrimethoxysilane can be mentioned.

The coating can take place for example by mixing of the metal oxide components or metal sulphide components in a suitable mixing vessel, the surface modifying reagent being sprayed on simultaneously. Optionally, the metal oxide components or metal sulphide components can be treated with water or acid before spraying with the surface-modifying reagent. Annealing is generally then performed at a temperature of 100 to 400° C. for several hours.

Generally formwork release oils are liquid hydrophobic compounds, which are able to reduce the adhesion between the concrete and the surface of the formwork. In the present invention the formwork release oils are not especially limited. The usual formwork release oils known in the art can be used. The term oil in this invention has a broader meaning than in the chemical sense and includes for example also aliphatic hydrocarbons.

The oil component (formwork release oil) in the formwork release composition according to the invention is preferably selected from fatty acid esters, triglycerides, higher alcohols with at least 6 carbon atoms, mineral oils and mixtures thereof. Mineral oils based on aliphatic hydrocarbons are preferred. Especially preferred are hydrocarbons with a chain length of 8 to 30 carbon atoms and more preferably 9 to 12 carbon atoms.

In this context, reference may in particular be made to the "Hydroseal" range from TotalFinaElf which contain a low proportion of aromatic compounds.

It has further been found advantageous if the ratio of the formwork release oil in the formwork release composition to the metal oxide component is 200:1 to 2:1 parts by weight and preferably 25:1 to 10:1 parts by weight.

The already described surprising effects of the formwork release composition according to the invention can be further increased if the formwork release oil contains photocatalytically active compounds as the metal oxide component. Here the invention envisages in particular semiconductors and in particular $TiO_2$, ZnO, $Fe_2O_3$ and/or ZnS. Preferred is titanium dioxide.

In the case of the use of $TiO_2$ at least some of it is preferably present in the anatase structure, contents of at least 40%, at least 70% and particularly 80% being regarded as advantageous. The respective contents are based on the total quantity of the $TiO_2$ used.

A form of $TiO_2$ which is a mixture of 70 to 100 wt. % anatase and 0 to 30 wt. % rutile has been found particularly preferable.

It has already been pointed out that the advantages of the formwork release composition claimed lie in particular in the fact that there is no absolute need for it to contain any further additives and that there is no need for further processing steps (the formwork release composition is anyway applied to the formwork). However, in specific use situations it can be necessary to add at least one further component selected from preservatives, wetting agents, antioxidants and emulsifiers to the formwork release composition, which is likewise also included by the present invention.

As well as the formwork release composition itself, the present invention also envisages the use thereof and here in particular the production of exposed concrete, preferably exposed white concrete wherein the formwork release composition is in particular applied onto the contact side of the formworks. Finally, the present invention also includes exposed concrete which has been produced with the aid of the formwork release composition described.

In summary, it can be noted that with the aid of the proposed formwork release composition exposed concrete surfaces can now be produced which have at least the same favourable properties as exposed concrete objects to which photo-catalytically active metal oxides, such as for example titanium dioxide, have been added to the unset mixture. Due to the formwork release composition, the hydrophobic metal oxide component(s) and/or metal sulphide components are concentrated on the surface of the concrete or mortar moulded object, where they are needed for their antisoiling activity. The homogeneous admixture of metal oxides and/or metal sulphides into the whole mass of the concrete or mortar is according to the present invention not necessary, which is of course advantageous from the economic point of view, because it is possible to use much less of these compounds. On the other side the hydrophobic metal oxides and/or metal sulphides can also penetrate into the construction material (fresh concrete or mortar) lying somewhat deeper on account of the rough and/or porous surface (e.g. by diffusion). This is one of the reasons for the surprisingly persistent anti soiling effect. If the surface of the building material is damaged by for example abrasion there is still some antisoiling material in the deeper regions of the construction material present in order to replace the antisoiling material directly on the surface The action of such metal oxides and/or metal sulphides in fact manifests itself mainly in the regions close to the surface. By means of the formwork release composition claimed and the use thereof also claimed, concrete and mortar surfaces which have self-cleaning properties can be obtained. The difference compared to the state of the art can also be seen in that hitherto only hydrophilic active metal oxides were used for photocatalytic applications in connection with construction chemical mixtures.

As already mentioned titanium dioxide, which is preferably produced by flame hydrolysis processes from titanium tetrachloride ($TiCl_4$) and which is preferably made hydrophobic by coating with suitable hydrophobic materials, is particularly to be recommended as a suitable hydrophobic metal oxide.

Overall, the formwork release compositions according to the present invention can very easily be processed, and they are in particular applied by coating, spraying, spray-coating, painting or brushing onto the surface of the formworks.

The following examples illustrate the advantages of the present invention.

EXAMPLES

For the following examples, mortar mixtures with white cement (CEM I 52.5R) as the binder and a normalized quartz sand (EN 196-1), with particle sizes ranging between 0.08 and 2 mm as the aggregate, were prepared by mixing with water in a water/cement ratio of 0.42. A polycarboxylic ether based superplasticizer (0.8 weight % with respect to cement) was added to improve the workability and to allow lower water/cement ratios. The fresh mortar mixture was filled into the prepared formworks. The wooden formworks with a standardized base area of 64 $cm^2$ and a height of 4 cm (UNE EN 480-1) were coated by spraying on their inner side with the following formwork release composition:

1. Example According to Invention 95 wt. % mineral oil of hydrocarbon chain distribution C 9 to C 12 (Spirdane D 60 from Total Espana S.A.)+5 wt. % Aeroxide® $TiO_2$ T805 from Evonik Degussa GmbH. Aeroxide® $TiO_2$ T805 is titanium dioxide made hydrophobic by means of surface modification with octyltrimethoxysilane. It is a mixture of anatase and rutile and has a specific surface area (BET) of 45±10 $mg/m^2$.

2. Comparison Example 2.1 Mineral Oil of Hydrocarbon Chain Distribution C 13 to C 19 (Hydroseal G 232 from Total Espana S.A.)

2.2 90 Wt. % Mineral Oil of Hydrocarbon Chain Distribution C 13 to C 19 (Hydroseal G 232 from Total Espana S.A.)+10 Wt. % Dispersant (Aerosil P 25 from Degussa Evonik GmbH)

After a hardening time of 28 days, the formworks were removed from the respective concrete test specimens, and they were exposed for two years to open air weathering under the meteorological conditions prevailing in Palau (Spain, situated northwest of Barcelona). The samples were oriented towards the south, so that appropriate solar irradiation was possible. At regular intervals, and after this time had elapsed, the following surface properties were tested and compared with the corresponding reference samples not according to the invention: degree of soiling/self-cleaning effect, presence of biological fouling, roughness and visual impression, in particular lightness of the samples of white mortar. As a result the concrete moulded parts produced using the formwork release composition 1 according to the invention had a homogeneous smooth surface overall. The degree of damage to the surface caused by removal of the formworks was markedly reduced compared to the concrete moulded parts according to the comparison example. The weathering experiments clearly confirm that the concrete moulded parts according to the invention display stable self-cleaning properties compared to the comparison moulded parts even over longer exposure times of at least two years. The degree of whiteness or the brilliance of the concrete moulded components according to the invention was also clearly increased compared to the comparison examples, and this effect also persisted undiminished over an observation period of 6 to 24 months. Biological fouling (growth of algae, yeasts, lichens, fungi etc.) was not observed.

The invention claimed is:

1. A method for the production of exposed concrete comprising applying a formwork release composition onto the surface of a formwork prior to placing an unset cementitious composition adjacent to the formwork, the formwork release composition containing formwork release oil, wherein hydrophobic metal oxide component(s) and/or metal sulphide component(s) are contained.

2. The method of claim 1, wherein the metal oxide component(s) and/or the metal sulphide component(s) are surface-modified by coating with hydrophobic materials.

3. The method of claim 2, wherein the hydrophobic coating materials are selected from cyclic polysiloxanes, polysiloxanes and/or silicon-containing compounds, which have at least one $C_1$-$C_{18}$ alkyl, aryl and/or $C_1$-$C_{18}$ aralkyl group in their structure, wherein a silicon atom is substituted with at least one alkoxy group and/or at least one halogen atom.

4. The method of claim 1, wherein the formwork release oil is selected from fatty acid esters, triglycerides, higher alcohols with at least 6 carbon atoms, mineral oils or mixtures thereof.

5. The method of claim 1, wherein the formwork release oil contains an aliphatic hydrocarbon with a chain length of 8 to 30 carbon atoms.

6. The method of claim 1, wherein the ratio of the formwork release oil in the formwork release composition to the metal oxide component(s) and/or the metal sulphide component(s) is 200:1 to 2:1 parts by weight.

7. The method of claim 1, wherein the formwork release composition contains photocatalytically active compounds as the metal oxide component(s).

8. The method of claim 1, wherein the metal oxide component(s) and/or the metal sulphide component(s) are semiconductors selected from $TiO_2$, ZnO, $Fe_2O_3$, ZnS, or mixtures thereof.

9. The method of claim 8, wherein the $TiO_2$ is at least partly present in an anatase structure.

10. The method of claim 8, wherein the $TiO_2$ is present as a mixture of 70 to 100 wt. % anatase and up to 30 wt. % rutile.

11. The method of claim 1, wherein the formwork release composition contains at least one component selected from preservatives, wetting agents, antioxidants, or emulsifiers.

* * * * *